US006866269B2

(12) United States Patent
Liebau et al.

(10) Patent No.: US 6,866,269 B2
(45) Date of Patent: Mar. 15, 2005

(54) PARACHUTE DEVICE WITH IMPROVED HANDLE

(75) Inventors: Douglas A. Liebau, Highland Park, NJ (US); Kevin D. Cook, Fort Lee, NJ (US)

(73) Assignee: Flaghouse, Inc., Hasbrouck Heights, NJ (US)

( * ) Notice: Subject to any disclaimer, the term of this patent is extended or adjusted under 35 U.S.C. 154(b) by 0 days.

(21) Appl. No.: 10/280,374

(22) Filed: Oct. 25, 2002

(65) Prior Publication Data

US 2003/0080504 A1 May 1, 2003

Related U.S. Application Data

(60) Provisional application No. 60/335,730, filed on Nov. 1, 2001.

(51) Int. Cl.[7] ..... A63B 67/00
(52) U.S. Cl. ..... 273/441; 273/440; 273/459
(58) Field of Search ..... 273/440, 441, 273/459; 472/49; 446/49; 244/142, 145

(56) References Cited

U.S. PATENT DOCUMENTS 4,709,430 A * 12/1987 Nicoll ..... 5/417
4,867,444 A * 9/1989 Castillo ..... 482/106
5,135,222 A * 8/1992 Spector ..... 473/576
5,388,787 A * 2/1995 Webb et al. ..... 244/145
5,681,248 A * 10/1997 Vani ..... 482/126
D418,894 S * 1/2000 Kuo ..... D21/811
6,113,453 A 9/2000 Stuffelbeam
6,129,635 A * 10/2000 Kuo ..... 472/49
6,554,277 B1 * 4/2003 Descamps et al. ..... 273/113

OTHER PUBLICATIONS

Porthole Parachute and Grip Star Chutes, ("Sportime elementary" 2000 Spring catalog, Sportime, LLC), cover page and pp. 114–115.*
Gil Szautner. "Parachute Play". Interaction, Canadian Child Care Federation, Summer 1994 [online], [retrieved on Jul. 27, 2002]. Retrieved from the Internet: <URL:http://cfc–efc.ca/docs/cccf/0004_en.htm>.*

* cited by examiner

*Primary Examiner*—Raleigh W. Chiu
(74) *Attorney, Agent, or Firm*—Synnestvedt & Lechner LLP

(57) ABSTRACT

A parachute-type amusement device including an outer section extending around at least a portion of the device to provide a hand graspable handle, and an inner section having a sheet of flexible material capable of billowing with air upon manipulation of the device. The handle permits easy folding of the device for compact storage, e.g., in a bag or pouch. In one embodiment, the outer section has multiple handle members, such as foam inserts. In another embodiment, there is a single flexible handle member, such as a rope, cord, braid, and/or a tubular foam insert. The handle members may be spaced from one another within the outer section to facilitate grasping and/or folding of the device. The sheet may be circular, rectangular, etc., and may be visually divided into a multiple discrete segments, e.g. by coloration. A discrete number of foam inserts may be positioned within each of segment.

17 Claims, 6 Drawing Sheets

PARACHUTE DEVICE WITH IMPROVED HANDLE

RELATED APPLICATIONS

This application claims the benefit of U.S. Provisional Patent Application No. 60/335,730 filed Nov. 1, 2001, the disclosure of which is hereby incorporated herein by reference.

FIELD OF THE INVENTION

The present invention relates to parachute-type amusement and physical development devices and, more particularly, to a "parachute" device for playing games and/or exercising.

BACKGROUND OF THE INVENTION

Parachutes of various configurations are well known for creating wind resistance to slow an object's movement. Also known are parachute-type amusement devices which are particularly popular with elementary-school aged children. In one popular parachute activity, children, holding the parachute horizontally, collectively pull the parachute up and down to cause the parachute to billow with air. While air escapes beneath the parachute or through a centrally located vent, the children may do various things such as run beneath the parachute. Such use provides fun and resistance-based exercise.

Another parachute game involves the use of a specially configured parachute device including a sheet of flexible material defining one or more openings, and one or more pockets, each defining a mouth joined to the sheet around an opening. Such a device is disclosed in U.S. application Ser. No. 09/645,114, filed Aug. 24, 2000, the disclosure of which is hereby incorporated herein by reference. In use, this parachute device may be held horizontally and selectively tilted to maneuver a ball along the sheet, through one of the openings, and into a pocket. This and other parachute games teach leadership, communication, goal sharing, and problem solving.

Most parachute games require children to grip the parachute device around its outer edge. Some parachute devices are not configured with handles and thus may be difficult to grab and hold, particularly by young users with relatively little hand strength.

Other parachute devices are configured with discrete handles, such as nylon straps or webbing. Such handles are typically formed as a part of the parachute or stitched to its outer edge but are prone to tearing away from the parachute, which may damage the parachute device. In either case, the parachute device may be rendered unusable. Additionally, the discrete handles limit the number of children that may grasp the parachute. Additionally, if such handles are large enough to admit passage of a child's head and/or neck, they pose a choking risk.

SUMMARY OF THE INVENTION

In one embodiment, the outer section has multiple handle members, such as cylindrical foam inserts, for grasping. In another embodiment, a single flexible handle member, which may include a rope, cord, braid, and/or a cylindrical foam insert, extends along the outer section.

A sheet of flexible material suitable for retarding air flow therethrough is affixed to the outer section and positioned within the inner section. The material is capable of billowing with air upon manipulation of the device.

In one embodiment, the outer section has multiple handle members, such as tubular foam inserts, for grasping. In another embodiment, a single flexible handle member, which may include a rope, cord, braid, and/or a tubular foam insert, extends along the outer section.

The device may include multiple handle members spaced from one another within the outer section to facilitate grasping and/or folding of the device. The sheet may be circular, rectangular, or any other suitable shape, and may be visually divided into a multiple discrete segments, e.g. by coloration, and a discrete number of foam inserts may be positioned within each of the discrete segments.

DETAILED DESCRIPTION

Figure 1:
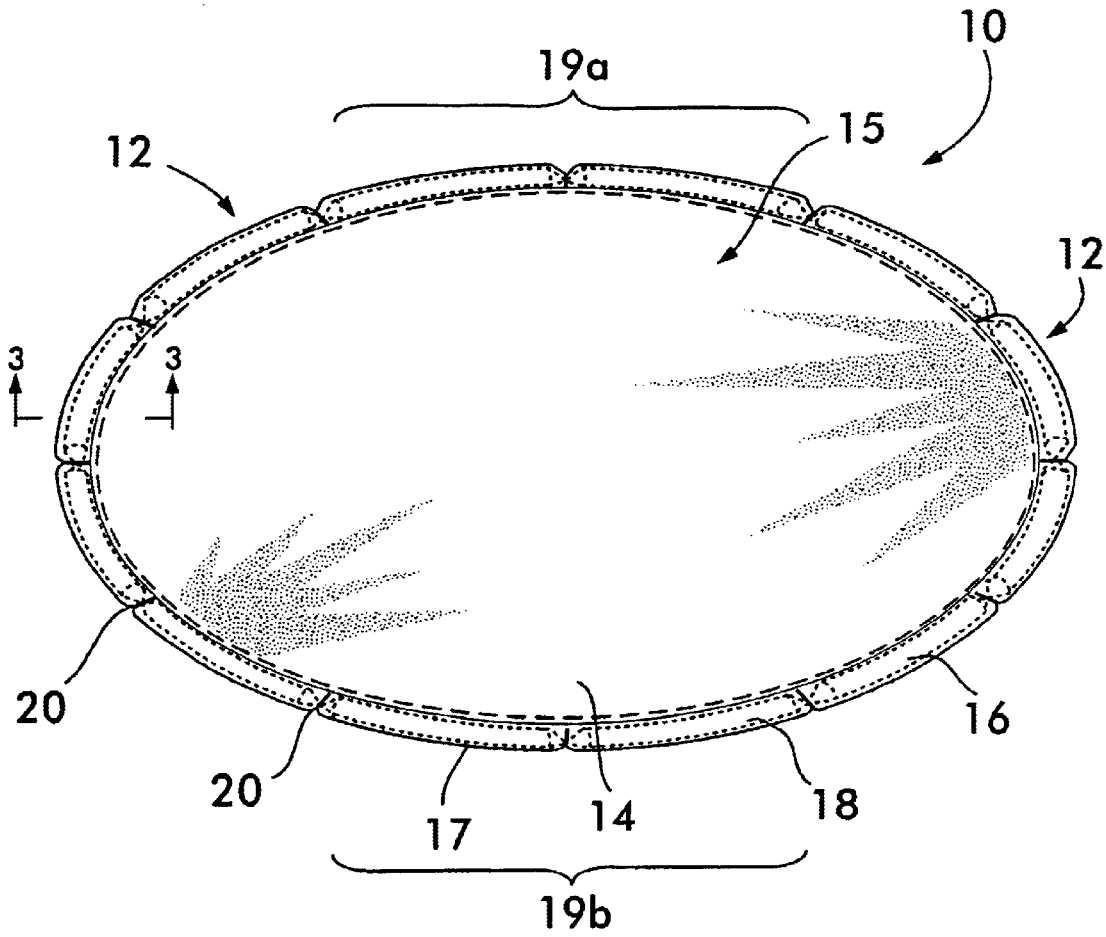
FIG. 1 is a perspective view of a parachute device in accordance with an exemplary embodiment of the present invention.
Figure 2:
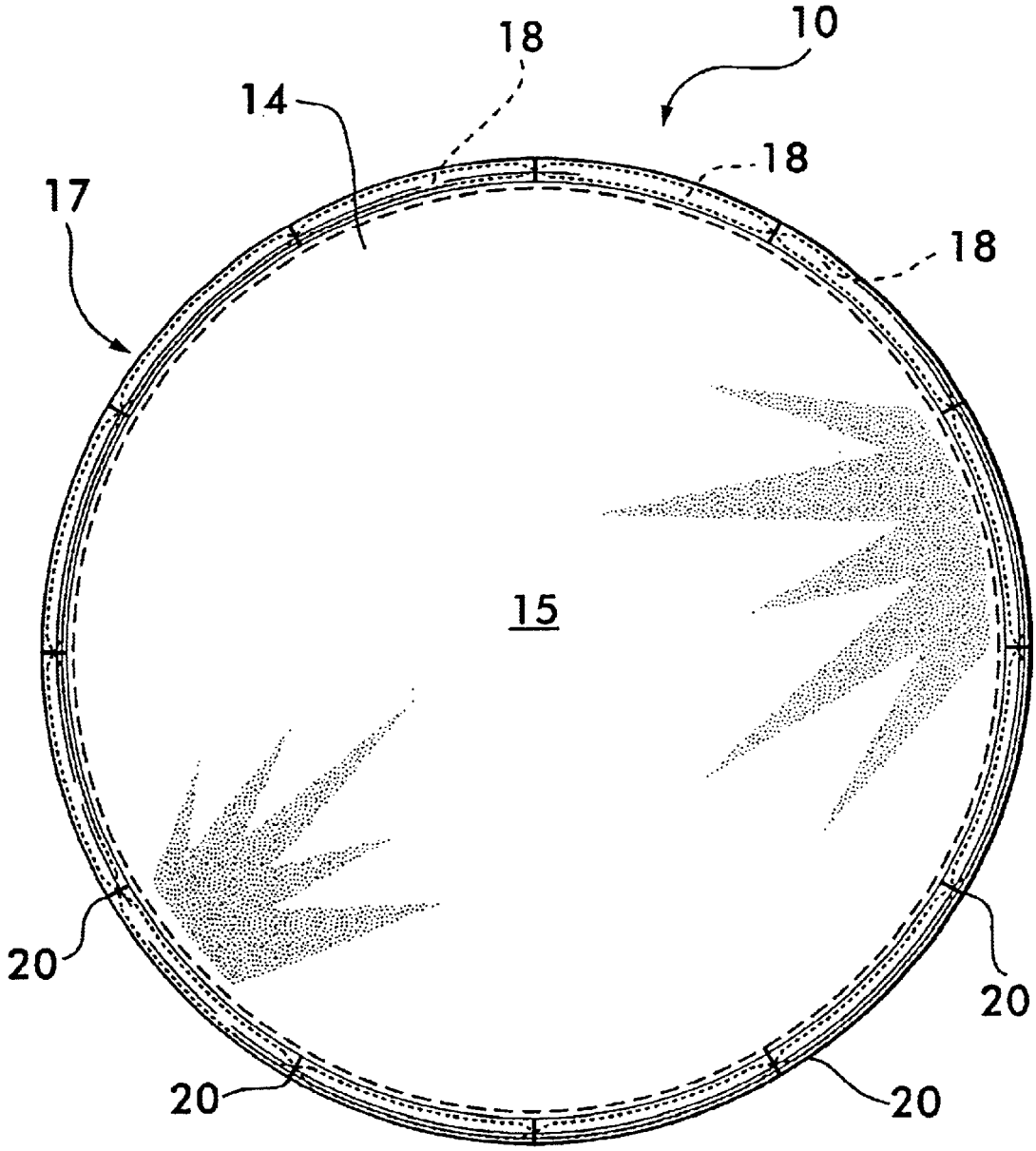
FIG. 2 is a top view of the parachute device of FIG. 1.

The present invention provides a parachute device having an integral handle that may be gripped easily and is easily foldable for compact storage, e.g. in a drawstring bag or pouch. FIGS. 1 and 2 are perspective and top views, respectively, of an exemplary parachute device 10 in accordance with a first embodiment of the present invention. In the example shown in FIGS. 1 and 2, the parachute device 10 includes an outer section 12 defining an inner section 15 of the device bounded by the outer section 12, and a sheet of flexible material 14 affixed to the outer section 12 and positioned within the inner section 15. The outer section 12 extends around at least a portion of the device 10 and defines at least a portion of the outer perimeter 17 of the device.

Optionally, the outer and inner sections 12, 15 are constructed of a single sheet. Any suitably shaped sheet, such as a substantially circular or substantially rectangular sheet, may be used. The sheet 14 is made of a lightweight material that is capable of retarding the flow of air therethrough, and so is capable of retarding movement of the device through air, and further capable of billowing with air upon manipulation of the device, such as a rip-stop nylon fabric or other fabric that is typical for parachutes. For devices having a substantially circular sheet, it is preferable that the sheet have a diameter of approximately six to thirty feet to accommodate numerous children positioned around the perimeter 17 when the parachute device 10 is used in a parachute game of a type generally known in the art.

Figure 3:
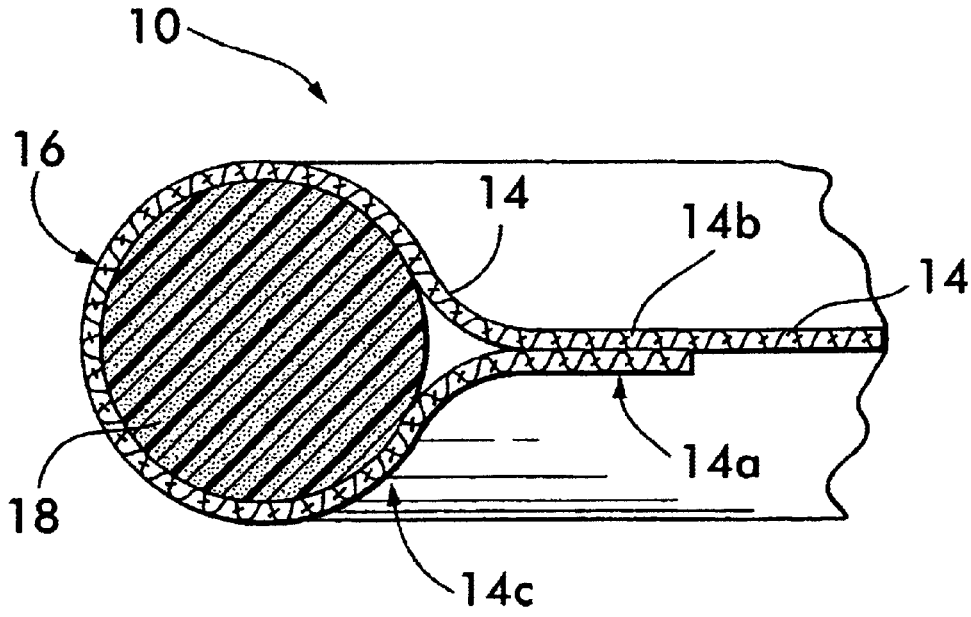
FIG. 3 is a partial cross-sectional view of the parachute device shown in FIG. 1, taken along line 3—3.

The parachute device 10 includes a closed loop 16 in the outer section 12. In one embodiment, the closed loop 16 is formed as a sleeve which is subsequently joined to the sheet 14 such that the loop 16 extends around, e.g. circumferentially, at least a portion of the sheet to define generally the perimeter 17 of the device. In the preferred embodiment, the closed loop 16 is formed by a portion of the sheet 14, as best shown in FIG. 3. For example, as shown in FIG. 3, a first portion 14*a* of the sheet 14 is joined to a second portion 14*b* of the sheet 14 to define the closed loop 16. This is achieved by folding over an outer edge portion 14*c* of the sheet 14 to form closed loop 16. The first and second portions 14*a*, 14*b* define generally ring-shaped portions (in cross-section) of sheet 14. For example, the first and second portions 14*a*, 14*b* may be joined by stitching, melting/fusing, etc. Optionally, excess portions of the first portion 14*a* may be cut out and removed to form "darts", and to allow for less bulk in joining of the first and second portions 14*a*, 14*b*. Any handle member(s) extend longitudinally within the loop 16, as discussed below.

Figure 2A:
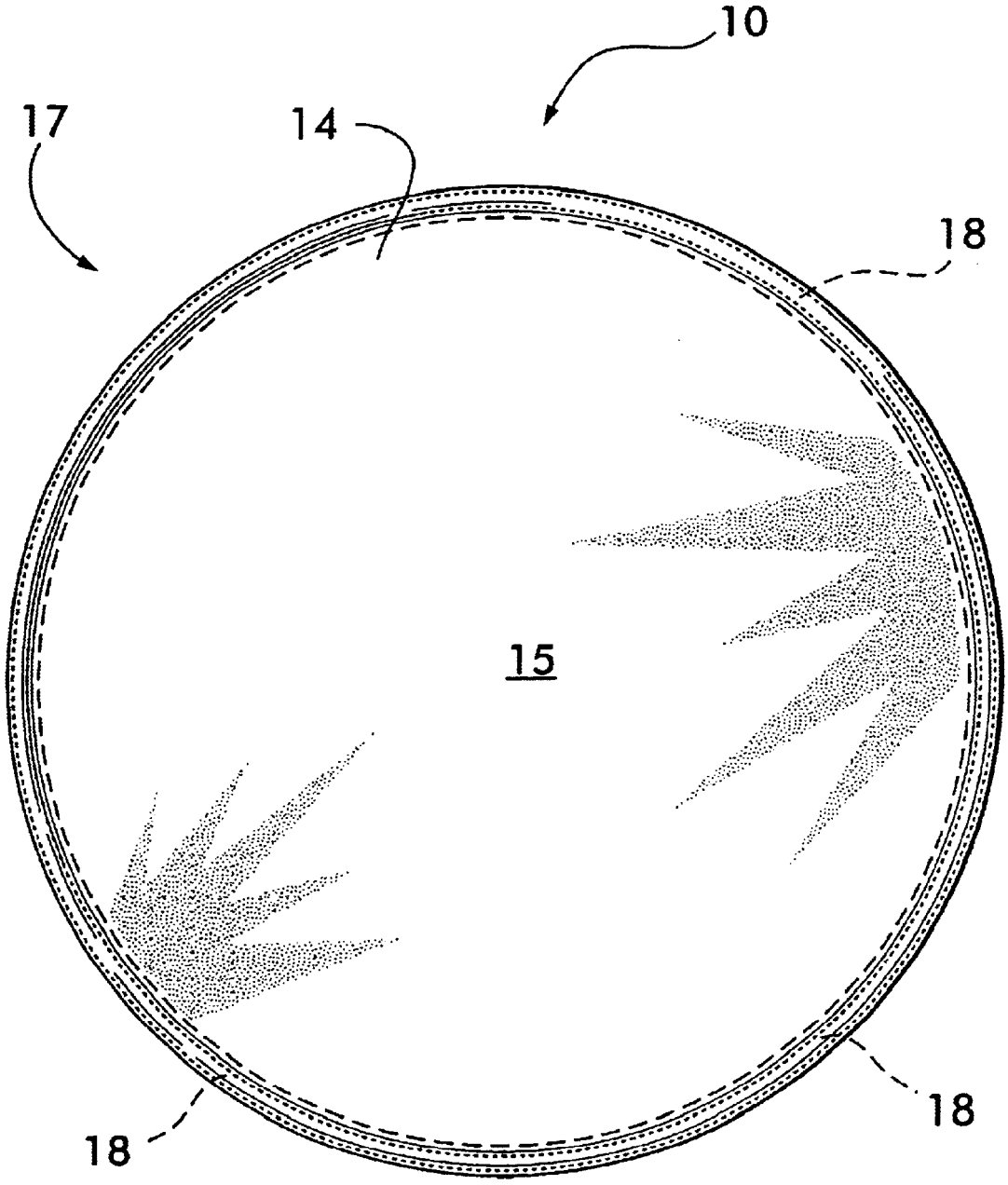
FIG. 2A is a top view of a device in accordance with an alternative embodiment of the present invention.

As best shown in FIG. 1, the outer section 12 of the parachute device 10 has a hand graspable handle extending longitudinally in at least a portion of the outer section 12. The handle includes at least one cylindrical handle member extending longitudinally along the edge of the device 10. As used herein, a cylindrical handle member is any handle member that is substantially cylindrical along its length, such as a piece of foam/foam insert, rope, cord, braid, etc. Due to the high degree of flexibility of such handle members, a single handle member may be used (see FIG. 2A), and the handle member may be continuous or nearly continuous while the device remains easily foldable for compact storage, e.g., in a bag or pouch. When relatively less flexible foam members are used, it may be desirable to use multiple handle members that are spaced from one another in the outer section, the areas of separation between handle members providing the desired degree of foldability.

The parachute device 10 illustrated in FIG. 1 includes multiple foam-type cylindrical handle members 18 (foam inserts) that provide lightweight and safe handles. The cylindrical handle members (foam inserts) are disposed generally opposite one another along opposing portions, e.g. 19*a*, 19*b*, of the outer section 12. In this embodiment, the foam inserts 18 extend along the entire perimeter 17 (circumference) of the device 10.

Figure 4:
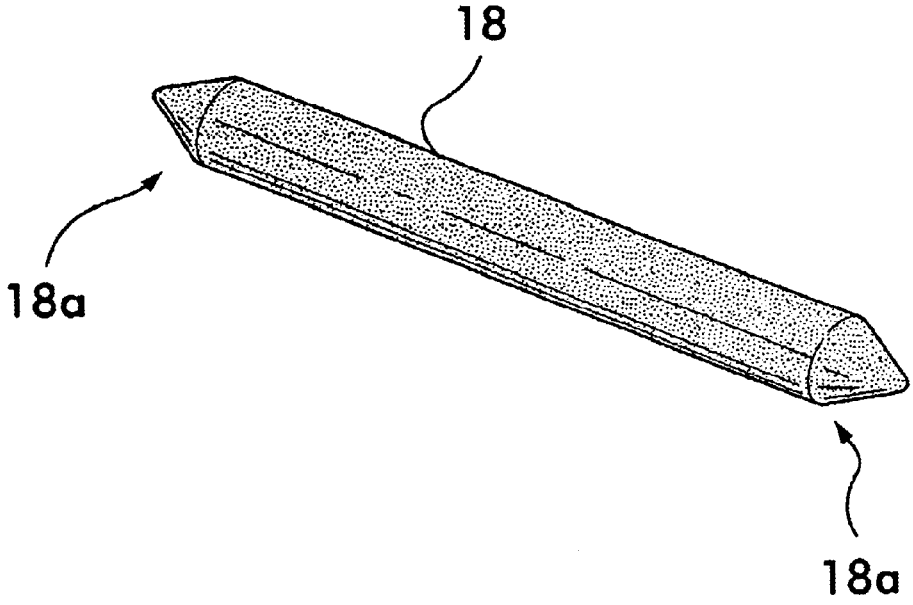
FIG. 4 is a perspective view of a foam insert used in the device of FIG. 1.

A perspective view of a foam insert 18 is shown in FIG. 4. The foam inserts 18 may be constructed of an expanded polyethylene (EPE) material or other suitable foam material. The foam inserts 18 preferably have a uniform cross-section along their length, e.g. they are cylindrical. Additionally, the foam inserts 18 preferably have a uniform single cross-section, i.e., they are solid foam and do not have a hollow core. Each of the foam inserts 18 is preferably cylindrical, with a diameter of approximately one to two inches and a length of approximately twelve to approximately twenty inches. The diameter of the foam inserts 18 may be varied to provide for easy gripping by children of various ages. The length of the foam inserts 18 may be varied as a function of the dimensions of the sheet 14 and to accommodate the desired number of children. For example, a larger sheet may be provided with longer foam inserts, or a sheet of a given size may be provided with smaller foam inserts to provide more handles and allow more children to grip the parachute.

Each of the foam inserts 18 has a pair of longitudinally-extending end portions 18*a* (FIG. 4). In the illustrated embodiment, the end portions 18*a* are longitudinally tapered, as shown in FIG. 4. In other embodiments, each insert is cut squarely at each end portion. The tapered portions 18*a* enhance the foldability of the amusement device 10 for storage purposes. Other types of configurations may work as well.

The foam inserts 18 are positioned within the closed loop 16, as shown in FIGS. 1–3 and are usable as handles for gripping the device 10. A child may grip a foam insert 18 as a handle to manipulate at least a portion of the device, e.g., by moving the handle up and down to cause the device 10 to billow with air and/or to tilt a portion of the device 10 to cause a ball (not shown) to roll along its surface.

It may be advantageous to limit the movement of the foam inserts 18 within the closed loop 16 to ensure uniform distribution of the foam inserts around the perimeter 17 of the sheet 14. Accordingly, as shown in the exemplary parachute device 10 of FIGS. 1–2, the parachute device 10 may include preferably at least two stitches 20. As used herein, a "stitch" is a run of stitching that may include one or more actual stitches. Each of the stitches 20 extends at least partially across the closed loop 16. In the circular sheet 14 shown in FIG. 1, the stitches 20 extend radially. The stitches 20 cooperatively limit displacement of a handle member within the outer section 12. In other words, the foam insert 18 cannot be moved within the closed loop 16 past the stitch 20. In one such embodiment, each foam insert 18 is fixedly positioned within the closed loop 16 by at least two stitches 20 (one at each end of the foam insert 18). For example, at least one stitch 20 extends between every two adjacent foam inserts 18 to space and separate the foam inserts from one another within the closed loop 16. Increasing the distance between ends of adjacent foam inserts 18 may enhance the foldability of the device 10. A distance of about 1.5 to 2.5 inches has been found suitable.

Figure 5:
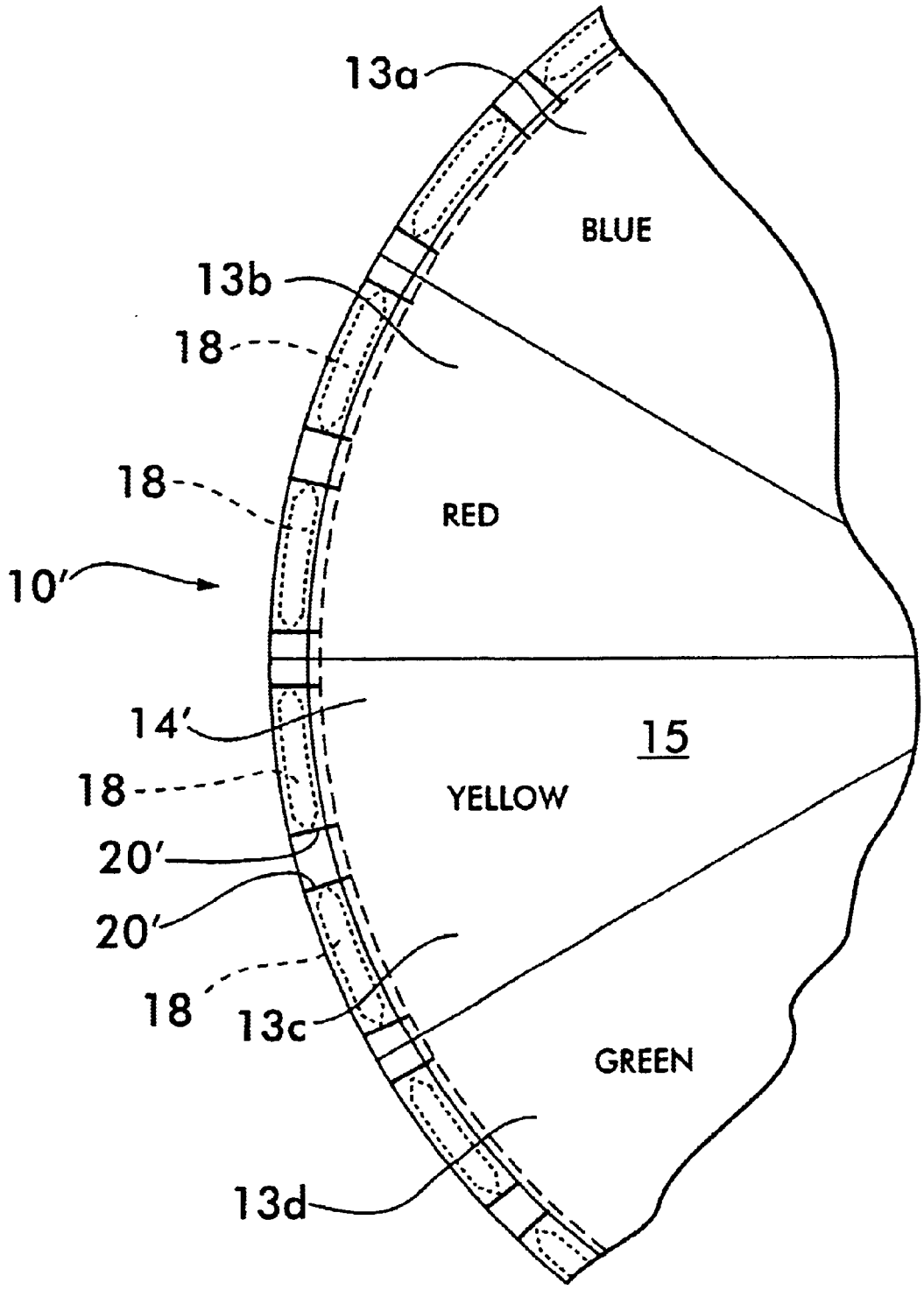
FIG. 5 is a partial top view of an exemplary parachute device in accordance with another alternative embodiment of the present invention.

FIG. 5 is a partial top view of an exemplary amusement device 10' in accordance with another alternative embodiment of the present invention. In this embodiment, the device 10' includes a sheet 14' which is visually divided into a plurality of discrete segments, e.g. 13*a*, 13*b*, 13*c*, 13*d*. Each discrete segment is a sector of the circular sheet 14'. For example, the sheet 14' may be visually divided by coloration—13*a* could be blue, 13*b* red, 13*c* yellow, and 13*d* green. This may be achieved by printing, painting or dyeing the sheet, or by stitching differently colored pieces of fabric together to form the sheet.

Optionally, a discrete, i.e. a whole, number of multiple foam inserts 18 is positioned within each of the discrete segments, e.g. 13*a*, 13*b*, 13*c*, 13*d*. As shown in FIG. 5, two foam inserts 18 are positioned within each of the discrete segments. This is advantageous because it facilitates grouping of game playing children into teams, e.g. the children grasping the foam inserts 18 in the red segment 13*b* would be grouped as the "red" team. Such teams are required for many traditional parachute games.

Optionally, the sheet 14 or 14' of the parachute device 10 may define a central opening (not shown). For example, the central opening may be covered by a mesh panel attached to the sheet. Such a central opening acts as a vent, as is well known in the art.

Figure 6:
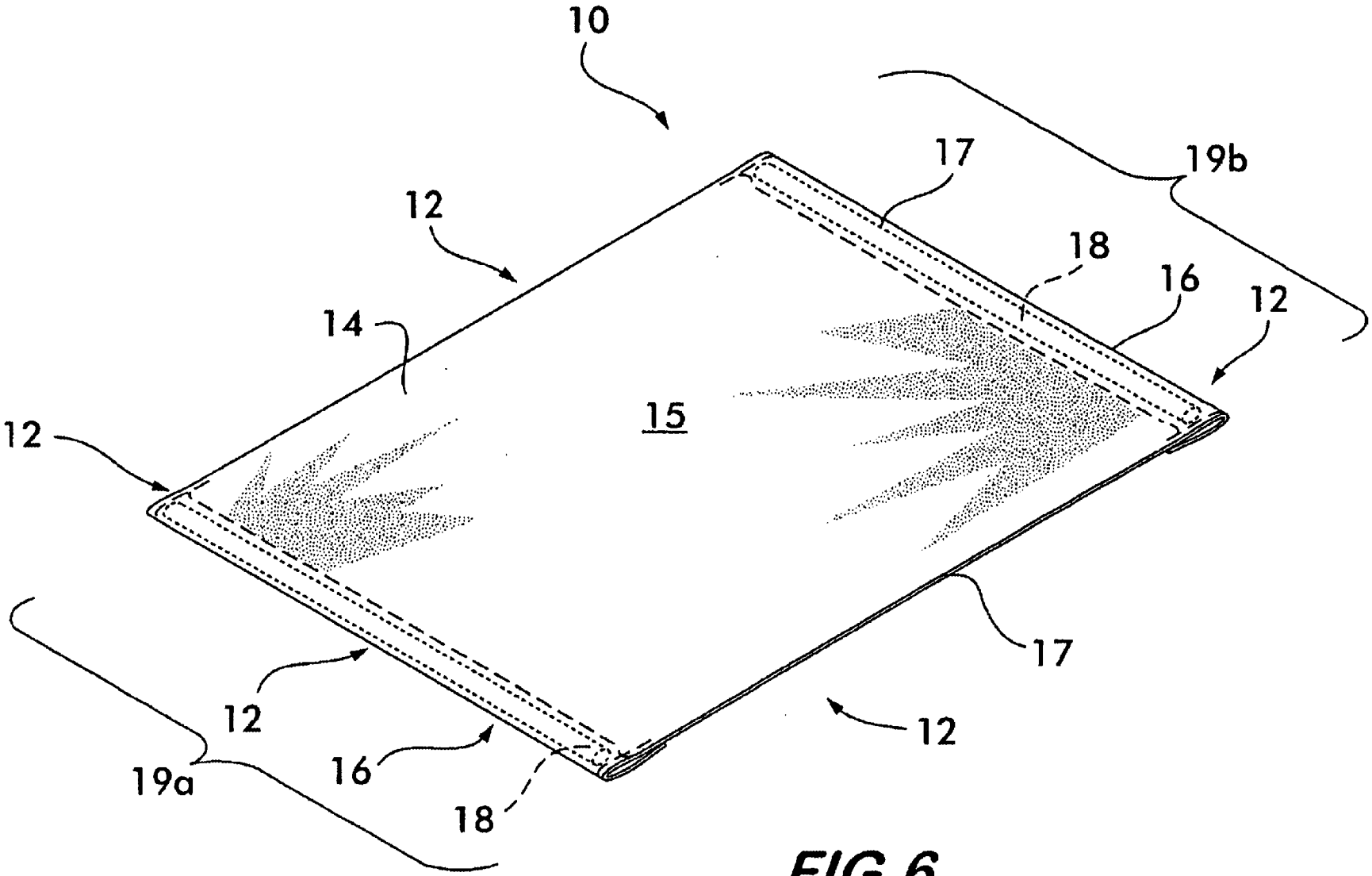
FIG. 6 is a perspective view of an exemplary parachute device in accordance with yet another alternative embodiment of the present invention.

FIG. 6 is a perspective view of an exemplary parachute device in accordance with yet another alternative embodiment of the present invention. In FIG. 6, corresponding parts have been labeled with like reference numerals. Accordingly, FIG. 6 shows a parachute device 10 including an outer section 12 defining an inner section 15 of the device. A substantially rectangular sheet of flexible material 14 is affixed to the outer section 12 and positioned within the inner section 15. A rectangularly shaped sheet 14 is particularly suitable for resistance-based exercise or volleying or juggling games. For example, for such uses a square sheet measuring four to six feet per side has been found desirable.

The outer section 12 has a plurality of foam-type handle members 18 extending along opposing portions, 19*a*, 19*b*, of the perimeter 17. The parachute device 10 includes a closed loop pocket 16 adjacent the perimeter 17 of the sheet 12. Handle members 18 are positioned within the closed loop(s) 16, and retained therein by stitching, on opposite ends of the device 10. This arrangement is similar to that shown in FIG. 3. In alternate embodiments, the handle members are affixed to an external surface of the sheet, e.g. by stitching, gluing, fusing, etc., rather than being disposed within a closed loop or pocket.

In the embodiment of FIG. 6, the handle members 18 do not extend along the entire perimeter, but rather along portions of the perimeter. In particular, the handle members extend along two opposing sides 19*a*, 19*b*, of the sheet 14.

In the parachute device of FIG. 6, a single handle member is provided on each side 19*a*, 19*b* of the sheet 14. In alternate embodiments, a plurality of handle members extends along each side 19*a*, 19*b* of the sheet 14, e.g. at least two on each side. Such an arrangement enhances the foldability of the device 10. In alternate embodiments, one or more highly flexible handle members are provided on each side 19*a*, 19*b* or the sheet 14.

The handle members 18 extend on opposite ends of the parachute device 10, as shown in FIG. 6, i.e. along opposite portions of the perimeter 17. In some alternate embodiments, only portions of the handle members extend opposite one another, while in other altemate embodiments, the handle members are staggered such that no portion of the handle members that extend opposite one another along the perimeter.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A parachute device comprising:

an outer section extending around at least a portion of the device and defining at least a portion of the outer perimeter of the device, said outer section further defining an inner section of the device bounded within said outer section;

said outer section comprising a plurality of discrete handle members extending peripherally along said outer section, each of said plurality of discrete handle members being adjacent to and peripherally spaced from another of said plurality of discrete handle members, each of said discrete handle members having a pair of longitudinally-extending end portions, each of said pair of end portions being longitudinally tapered toward respective distal ends of a respective member; and a sheet of flexible material suitable for retarding air flow therethrough affixed to said outer section and positioned within said inner section, said material being capable of billowing with air upon manipulation of the device.

2. The parachute device of claim 1, wherein each of said discrete handle members comprises foam.

3. The parachute device of claim 2, wherein said plurality of discrete handle members are disposed opposite one another along said outer section.

4. The parachute device of claim 2, wherein each of said plurality of discrete handle members has a length in the range of about twelve to about twenty inches.

5. The parachute device of claim 1, wherein each of said discrete handle members comprises a rope.

6. The parachute device of claim 1, wherein at least one of said plurality of discrete handle members is cylindrical along a portion of its length.

7. The parachute device of claim 1, wherein the device is circular in shape and has a diameter in the range of about six feet to about thirty feet.

8. The parachute device of claim 1, wherein said material forms a closed loop, and wherein said plurality of discrete handle members are peripherally spaced from one another within said closed loop a distance suitable to permit said device to be foldable.

9. The parachute device of claim 1, further comprising a plurality of stitches in said material, each of said stitches separating adjacent ones of said plurality of discrete foam members.

10. A parachute device, comprising:

a sheet of flexible material suitable for retarding air flow therethrough and capable of billowing with air upon manipulation of the device; and an outer section bounding at least a portion of said sheet and comprising a plurality of discrete foam members extending peripherally along said outer section, adjacent ones of said plurality of discrete foam members being peripherally spaced from one another, said outer section comprising a loop of said material, said discrete foam members extending within said loop.

11. The parachute device of claim 10, wherein said device is circular, and said discrete foam members extend along the entire circumference of the device.

12. The parachute device of claim 10, further comprising a plurality of stitches in said material, each of said stitches separating adjacent ones of said plurality of discrete foam members within said closed loop.

13. The parachute device of claim 12, wherein each of said plurality of discrete foam members has a pair of longitudinally-extending end portions, each of said pair of end portions being longitudinally tapered toward respective distal ends of a respective discrete foam member.

14. A parachute device comprising:

an outer section extending around at least a portion of the device and defining at least a portion of the outer perimeter of the device, said outer section further defining an inner section of the device bounded within said outer section;

a sheet of flexible material suitable for retarding air flow therethrough, said sheet being affixed to said outer section and positioned within said inner section, said material being capable of billowing with air upon manipulation of the device, said material forming a closed loop extending peripherally and substantially continuously along said outer section; and a plurality of discrete members positioned within said closed loop and extending peripherally along said outer section, adjacent ones of said plurality of discrete members being peripherally spaced from one another.

15. The device of claim 14, wherein each of said discrete members comprises expanded foam.

16. The device of claim 15, further comprising a plurality of stitches in said material, each of said stitches separating adjacent ones of said plurality of discrete members within said closed loop.

17. A parachute device comprising:

a sheet of flexible material suitable for retarding air flow therethrough, said material being capable of billowing with air upon manipulation of the device, said sheet being substantially rectangular in shape and having a pair of ends opposite one another;

an outer section extending around at least a portion of the device and defining at least a portion of the outer perimeter of the device, said outer section further defining an inner section of the device bounded within said outer section;

a plurality of discrete handle members disposed along said pair of ends, there being at least one of said discrete handle members along each of said ends, each of said plurality of discrete handle members being peripherally spaced from another of said plurality of discrete handle members; and said sheet being affixed to said outer section and positioned within said inner section.

* * * * *